US007819389B2

(12) United States Patent
Takeuchi et al.

(10) Patent No.: US 7,819,389 B2
(45) Date of Patent: Oct. 26, 2010

(54) HOISTING AND LOWERING DEVICE HAVING ENGAGEMENT CHAINS

(75) Inventors: Yoshifumi Takeuchi, Osaka (JP); Naoto Shibata, Osaka (JP); Toru Wada, Osaka (JP); Tomoyuki Saji, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 12/214,318

(22) Filed: Jun. 18, 2008

(65) Prior Publication Data

US 2008/0315168 A1 Dec. 25, 2008

(30) Foreign Application Priority Data

Jun. 21, 2007 (JP) ..... 2007-163790

(51) Int. Cl.
*B66D 1/20* (2006.01)

(52) U.S. Cl. ..... 254/358; 254/342; 254/362

(58) Field of Classification Search ..... 254/342, 254/358, 362
See application file for complete search history.

(56) References Cited

U.S. PATENT DOCUMENTS

| | | | | |
|---|---|---|---|---|
| 4,867,277 | A * | 9/1989 | Sloan | 187/243 |
| 5,339,749 | A * | 8/1994 | Hirose | 108/143 |
| 6,286,812 | B1 * | 9/2001 | Cherry | 254/9 C |
| 6,516,478 | B2 * | 2/2003 | Cook et al. | 5/611 |
| 6,742,768 | B2 * | 6/2004 | Alba | 254/122 |
| 2003/0075657 | A1 * | 4/2003 | Joubert | 248/277.1 |
| 2003/0168646 | A1 * | 9/2003 | Lopez Alba | 254/122 |

FOREIGN PATENT DOCUMENTS

| | | |
|---|---|---|
| JP | 60-45958 | 4/1985 |
| JP | 07-223800 | 8/1995 |
| JP | 10-175796 | 6/1998 |
| JP | 11-049487 | 2/1999 |
| JP | 11-193199 | 7/1999 |
| JP | 11-278797 | 10/1999 |
| JP | 2003-004104 A1 | 1/2003 |
| JP | 2005-083429 A1 | 3/2005 |

OTHER PUBLICATIONS

Peripheral. (n.d.). The American Heritage® Dictionary of the English Language, Fourth Edition. Retrieved Oct. 20, 2009, from Dictionary.com website: http://dictionary.reference.com/browse/peripheral.*

* cited by examiner

*Primary Examiner*—Evan H Langdon
(74) *Attorney, Agent, or Firm*—William P. Oberhardt

(57) ABSTRACT

An engagement chain type hoisting and lowering device is disclosed, having a hoisting and lowering table attached to the upper end of two or more pairs of hoisting and lowering driving engagement chains. A driving motor drives two pairs of hoisting and lowering sprockets which, in turn, raise or lower two pairs of hoisting and lowering driving engagement chains. By arranging two pairs of hoisting and lowering driving engagement chains on two opposed sides of the hoisting and lowering table, buckling of the hoisting and lowering driving engagement chains is suppressed, resulting in stable hoisting and lowering operations without slippage of articles on the hoisting and lowering table, and chain endurance is improved. The device is designed so that the lowest position of the hoisting and lowering table can be lower than the height of the peripherally located driving motor, for ease and safety of operation and maintenance.

2 Claims, 10 Drawing Sheets

HOISTING AND LOWERING DEVICE HAVING ENGAGEMENT CHAINS

BACKGROUND OF THE INVENTION

1. Field of the Invention

The present invention relates to a hoisting and lowering device, which hoists and lowers a hoisting and lowering table in parallel with a set surface for use by production facilities in various kinds of production fields, a transfer facility, a care facility in a medical welfare field, a stage facility in an art field and the like, and more specifically relates to an engagement chain type hoisting and lowering device in which an engagement chain is adopted as a driving medium for hoisting and lowering operations.

2. Brief Description of the Related Art

In the field of hoisting and lowering devices, there has been a hoisting and lowering device, which hoists and lowers articles to be hoisted and lowered such as heavy articles by use of an engagement chain, which is integrally hoisted and lowered while being engaged with each other, a socalled chuck chain (see Japanese Laid-Open Patent Publication No. Hei. 11-278 797, particularly page 1 and FIG. 1).

However, since in a hoisting and lowering device using a conventional engagement chain, an engagement chain, which hoists and lowers while supporting the entire load containing articles to be hoisted and lowered, loaded on a loading rack-shaped load supporting member, is provided on one side of the load supporting member, in a case where articles to be hoisted and lowered are loaded on the load supporting member in a biased state, a biased load is loaded on one side of the load supporting member so that a loading surface of the load supporting member is changed from a parallel state to an inclined state. Thus, various ideas for making the shape of the load supporting member to be a box shape so that articles to be hoisted and lowered do not slide down have been required. And there has been a troublesome problem in that handling loading and unloading of the articles to be hoisted onto and lowered from such a box-shaped load supporting member becomes difficult. Further, there was a problem in hoisting and lowering operations that an engagement chain, which hoists and lowers while supporting the entire load containing loaded articles to be hoisted and lowered in an engaged state is liable to buckle so that the endurance of the chain is lost and unstable hoisting and lowering operations due to rolling of the engagement chain are liable to occur.

Further, since in the hoisting and lowering device using a conventional engagement chain, a motor, which hoists and lowers an engagement chain and a vertical wall-shaped accommodating guide portion are arranged in the vicinity of a pair of sprockets, the lowering position of the load supporting member cannot be lowered due to the sizes or heights of the driving motor and the pair of accommodating guide portions. That is, there were problems in hoisting and lowering operations, because the floor of the load supporting member cannot be lowered, and a large operational burden is required for loading and unloading of articles to be hoisted onto and lowered from the load supporting member.

BRIEF SUMMARY OF THE INVENTION

Accordingly, technical problems to be solved by the present invention, that is, the object of the present invention is to provide an engagement chain type hoisting and lowering device in which loaded articles to be hoisted and lowered are stably hoisted and lowered without them slipping down. Buckling of an engagement chain, which hoists and lowers in an engaged state, is suppressed so that excellent endurance of the chain is realized and the lowest lowered position of a hoisting and lowering table is lowered so that loading and unloading operations of the articles to be hoisted onto and lowered from the hoisting and lowering table and maintenance are safe and simple.

The present invention solves the above-described problems by an engagement chain type hoisting and lowering device comprising a pair of hoisting and lowering sprockets, which rotate positively and reversely in opposite directions while facing each other in the same plane about a pair of rotation shafts arranged in parallel with a set surface, a pair of hoisting and lowering driving engagement chains, which engage with each other just after deflection driving from a horizontal direction to a vertical direction by said pair of hoisting and lowering sprockets to rise integrally in an engaged state and also disengage with each other to be branched from a vertical direction to a horizontal direction by said pair of hoisting and lowering sprockets during deflection driving, a hoisting and lowering table securely attached to an upper end of said hoisting and lowering driving engagement chain, which table is integrally hoisted and lowered, and a driving motor, which drives said pair of hoisting and lowering sprockets, characterized in that said pair of hoisting and lowering driving engagement chains are respectively arranged on two opposing sides of said hoisting and lowering table.

The invention further solves the above-described problems in that in addition to the engagement chain type hoisting and lowering device described above, said hoisting and lowering driving engagement chains are respectively composed of a plurality of rows of chain links in a chain width direction by use of a hook-shaped inner tooth plate, a hook-shaped outer tooth plate, which overlaps said inner tooth plate while shifted by a half pitch with respect to the inner tooth plate in a longitudinal direction of the chain, a bush, which connects and fixes said inner tooth plates in the chain width direction, a roller fitted onto said bush, and a connecting pin connected to be fixed to said outer tooth plate in the chain width direction.

The invention further solves the above-described problems in that in addition to the engagement chain type hoisting and lowering device described above, a hoisting and lowering auxiliary guide means, which guides hoisting and lowering operations of said hoisting and lowering table in accordance with hoisting and lowering driving of said hoisting and lowering driving engagement chain, is provided between said hoisting and lowering table and a set surface side in an extendable state.

The invention further solves the above-described problems in that in addition to the engagement chain type hoisting and lowering device described above, said driving motor is disposed in a peripheral area spaced apart from the lowest lowered position of said hoisting and lowering table.

Further, the invention solves the above-described problems in that in addition to the engagement chain type hoisting and lowering device described above, an engagement chain accommodating means, which accommodates said pair of hoisting and lowering driving engagement chains while branched in a horizontal direction, is disposed in a peripheral area spaced apart from the lowest lowered position of said hoisting and lowering table.

Since the engagement chain type hoisting and lowering device according to the present invention comprises a pair of hoisting and lowering sprockets, which rotate positively and reversely in opposite directions while facing each other in the same plane about a pair of rotation shafts arranged in parallel with a set surface, a pair of hoisting and lowering driving engagement chains, which engage with each other just after deflection driving from a horizontal direction to a vertical direction by said pair of hoisting and lowering sprockets to rise integrally in an engaged state and also disengage with each other to be branched from a vertical direction to a horizontal direction by said pair of hoisting and lowering sprockets during deflection driving, a hoisting and lowering table securely attached to an upper end of said hoisting and lowering driving engagement chain, which table is integrally hoisted and lowered, and a driving motor, which drives said pair of hoisting and lowering sprockets, the hoisting and lowering table can be hoisted and lowered in accordance with positive and reverse rotations of hoisting and lowering sprockets irrespective of the hoisting and lowering positions. Thus, hoisting and lowering operations of the hoisting and lowering table can be rapidly attained at the same speed, and high design flexibility of the chain accommodating means and the driving portions can be realized. Additionally, significant benefits corresponding to the following particular configurations can be obtained.

That is, according to the engagement chain type hoisting and lowering device of the present invention, since a pair of hoisting and lowering driving engagement chains are respectively arranged on two opposing sides of the hoisting and lowering table, even if articles to be hoisted and lowered are loaded on the hoisting and lowering table in a biased state, and even if there is a fear of rolling of the chain liable to occur in a width direction of the hoisting and lowering table near the most upper hoisted position of the hoisting and lowering table, a pair of hoisting and lowering driving engagement chains respectively arranged on two opposing sides of the hoisting and lowering table are hoisted and lowered in an engaged state where the entire load containing loaded articles to be hoisted and lowered is shared and thereby reduced. Therefore, the articles to be hoisted and lowered can be stably hoisted and lowered on a parallel loading surface. And in a case where a hoisting and lowering auxiliary guide means, which guides hoisting and lowering operations of the hoisting and lowering table in accordance with hoisting and lowering driving of a hoisting and lowering driving engagement chain, which will be described later, is provided, since a biased load is not acted on by such hoisting and lowering auxiliary means, a smooth extendable guide function of the hoisting and lowering auxiliary means in accordance with the hoisting and lowering driving of the hoisting and lowering driving engagement chain can be attained.

And according to the engagement chain type hoisting and lowering device of the present invention, since in the engagement chain type hoisting and lowering device described herein, a pair of hoisting and lowering driving engagement chains are respectively composed in a plurality of rows of chain links in a chain width direction by use of a hook-shaped inner tooth plate, a hook-shaped outer tooth plate, which overlaps said inner tooth plate while shifted by a half pitch with respect to the inner tooth plate in a longitudinal direction of the chain, a bush, which connects and fixes said inner tooth plates in the chain width direction, a roller fitted onto said bush, and a connecting pin, which connects and fixes said outer tooth plate in the chain width direction, an outer tooth plate and an inner tooth plate forming one of the pair of hoisting and lowering driving engagement chains multiply and strongly engage with an outer tooth plate and an inner tooth plate forming the other opposite hoisting and lowering driving engagement chain so as to be a hook shape in a so-called chuck shape over a plurality of rows of chain links in a chain width direction. Thus, even if a biased load is loaded on one side of the hoisting and lowering driving engagement chain, which hoists and lowers in an engaged state while supporting the entire load containing loaded articles to be hoisted and lowered in the chain width direction, buckling of the hoisting and lowering driving engagement chain, liable to occur in the chain width direction, is reliably suppressed so that excellent endurance can be realized.

Further, according to the engagement chain type hoisting and lowering device of the present invention, since in the engagement chain type hoisting and lowering device described herein, a hoisting and lowering auxiliary guide means, which guides hoisting and lowering operations of said hoisting and lowering table in accordance with hoisting and lowering driving of said hoisting and lowering driving engagement chain is provided between said hoisting and lowering table and a set surface side in an extendable state, in addition to the benefits obtained by the engagement chain type hoisting and lowering device according described herein, the hoisting and lowering auxiliary guide means smoothly guides hoisting and lowering operations of the hoisting and lowering table while performing an auxiliary operation in accordance with hoisting and lowering driving of the hoisting and lowering driving engagement chain. Therefore, the stability of the hoisting and lowering table can be ensured.

Further, according to the engagement chain type hoisting and lowering device of the present invention, since in the engagement chain type hoisting and lowering device described herein, the driving motor is disposed in a peripheral area spaced apart from the lowest lowered position of the hoisting and lowering table, in addition to the benefits obtained by the engagement chain type hoisting and lowering device described herein, the lowest lowered position of the hoisting and lowering table can be lowered irrespective of a size or height of this driving motor. That is, since the floor of the hoisting and lowering table can be lowered, an operational burden of loading and unloading of articles to be hoisted onto and lowered from the hoisting and lowering table can be significantly reduced and at the same time the driving motor does not become an obstruction during maintenance of a hoisting and lowering mechanism so that a safe and simple maintenance operation can be attained.

Further, according to the engagement chain type hoisting and lowering device of the present invention, since in the engagement chain type hoisting and lowering device described herein, an engagement chain accommodating means, which accommodates said pair of hoisting and lowering driving engagement chains while branched in a horizontal direction, is disposed in a peripheral area spaced apart from the lowest lowered position of said hoisting and lowering table, in addition to the benefits obtained by the engagement chain type hoisting and lowering device according to the invention described herein, the lowest lowered position of the hoisting and lowering table can be lowered irrespective of a size or height of an accommodating space due to hoisting of a conventional hoisting and lowering driving engagement chain. That is, since the floor of the hoisting and lowering table can be lowered, an operational burden of loading and unloading of articles to be hoisted onto and lowered from the hoisting and lowering table can be significantly reduced and at the same time the maintenance of the hoisting and lowering driving engagement chain can be easily attained.

DETAILED DESCRIPTION OF THE INVENTION

Figure 1:
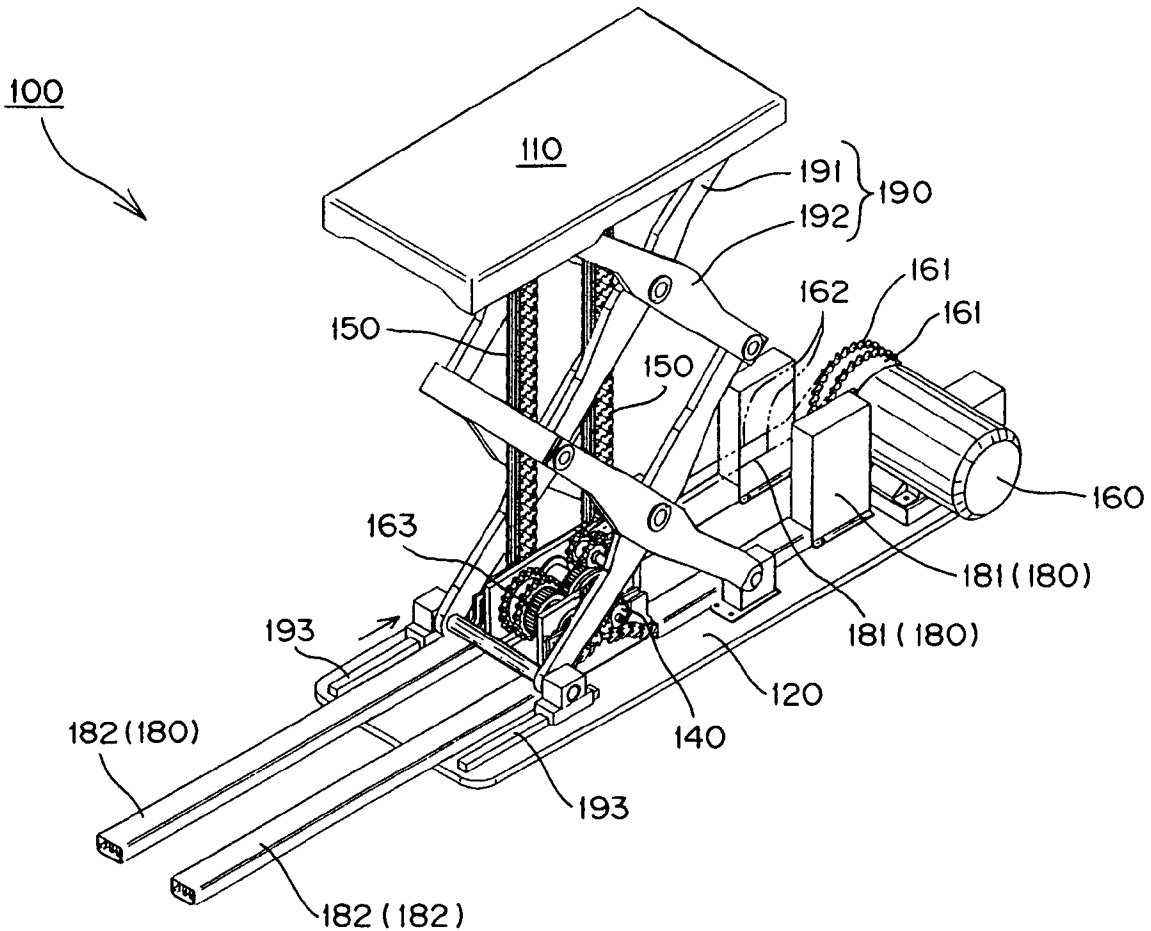
FIG. 1 is a perspective view of a first embodiment of the engagement chain type hoisting and lowering device of the present invention.

If an engagement chain type hoisting and lowering device according to the present invention comprises a pair of hoisting and lowering sprockets, which rotate positively and reversely in opposite directions while facing each other in the same plane about a pair of rotation shafts arranged in parallel with a set surface, a pair of hoisting and lowering driving engagement chains, which engage with each other just after deflection driving from a horizontal direction to a vertical direction by said pair of hoisting and lowering sprockets to rise integrally in an engaged state and also disengage with each other to be branched from a vertical direction to a horizontal direction by said pair of hoisting and lowering sprockets during deflection driving, a hoisting and lowering table securely attached to an upper end of said hoisting and lowering driving engagement chain, which table is integrally hoisted and lowered, and a driving motor, which drives said pair of hoisting and lowering sprockets, and the pair of hoisting and lowering driving engagement chains are respectively arranged on two opposed sides of said hoisting and lowering table, and if the engagement chain type hoisting and lowering device according to the present invention stably hoists and lowers loaded articles to be hoisted and lowered without slipping down them and suppresses buckling of an engagement chain, which hoists and lowers articles in an engaged state so that excellent endurance is realized, and if the lowest lowered position of the hoisting and lowering table is lowered so that loading and unloading operations of articles to be hoisted onto and lowered from the hoisting and lowering table and maintenance are safe and simple, any particular embodiments of the engagement chain type hoisting and lowering device of the present invention may be adopted.

For example, in the engagement chain type hoisting and lowering device of the present invention, even if a set surface is a floor surface on which the device is installed, or even if the set surface is a ceiling surface from which the device is hung, there is no problem in hoisting and lowering operations. And if the set surface is a lateral wall surface, which is a cantilever supporting form, there is no problem in advancing and retracting operations, which correspond to hoisting and lowering operations.

Further, the hoisting and lowering driving engagement chains respectively arranged on two opposed sides of a hoisting and lowering table in the engagement chain type hoisting and lowering device of the present invention are a socalled chuck chain. And if the hoisting and lowering driving engagement chains are engaged with each other just after deflection driving by a pair of hoisting and lowering sprockets from a horizontal direction to a vertical direction to integrally rise in an engaged state, and they also are disengaged from each other by the pair of hoisting and lowering sprockets from a vertical direction to a horizontal direction to be branched, any particular chain embodiments may be adopted. For example, any engagement chains such as a chain having a roller, a chain having a bush, a chain of a single row of chain links in the chain width direction, a chain of a plurality of chain link rows in the chain width direction, or a chain of their combination may be adopted. However, when the engagement chain of a plurality of rows of two or more chain link rows in the chain width direction is adopted, an outer tooth plate and an inner tooth plate forming one of a pair of hoisting and lowering driving engagement chains multiply and strongly engage with an outer tooth plate and an inner tooth plate forming the other opposite hoisting and lowering driving engagement chain so as to be a hook shape, also called a chuck shape, over a plurality of rows of chain links in a chain width direction. Thus, buckling of the hoisting and lowering driving engagement chain, liable to occur in the chain width direction, is reliably suppressed so that excellent endurance of the chain can be more preferably realized.

Further, according to the engagement chain type hoisting and lowering device of the present invention, a hoisting and lowering table, which hoists and lowers articles to be hoisted and lowered, is hoisted and lowered by driving force of the hoisting and lowering driving engagement chain. However, to guide stable hoisting and lowering operations of this hoisting and lowering table, a hoisting and lowering auxiliary guide means is preferably intervened between a hoisting and lowering table and a set surface side. Particular forms of the hoisting and lowering auxiliary guide means may be an X-shaped pantograph arm, which is used in a scissor lifter, and a telescopic pipe, which is used in a guide post lifter and the like.

Embodiments of the present invention will be described with reference to FIGS. 1 to 10.

An engagement chain type hoisting and lowering device 100, which is a first embodiment of the present invention, is set for hoisting and lowering a hoisting and lowering table 110 on which heavy articles (not shown) are loaded in parallel with a set surface as shown in FIG. 1.

In the engagement chain type hoisting and lowering device 100, which is the first embodiment of the present invention, comprises, as shown in FIGS. 1 to 4, a base plate 120 mounted on a set surface where the above-described hoisting and lowering table 110 is hoisted and lowered in parallel with each other, a pair of hoisting and lowering sprockets 140, 140, which rotate positively and reversely in opposite directions while facing each other in the same plane about a pair of rotation shafts 130, 130 arranged in parallel with the base plate 120, a pair of hoisting and lowering driving engagement chains 150, 150, which are disengaged from these pair of hoisting and lowering sprockets 140, 140 to hoist and lower the hoisting and lowering table 110, the above-described hoisting and lowering table 110 securely attached to an upper end of the hoisting and lowering driving engagement chains 150, 150, and a driving motor 160, which drives the pair of hoisting and lowering sprockets 140, 140, as basic device configurations.

Figure 2:
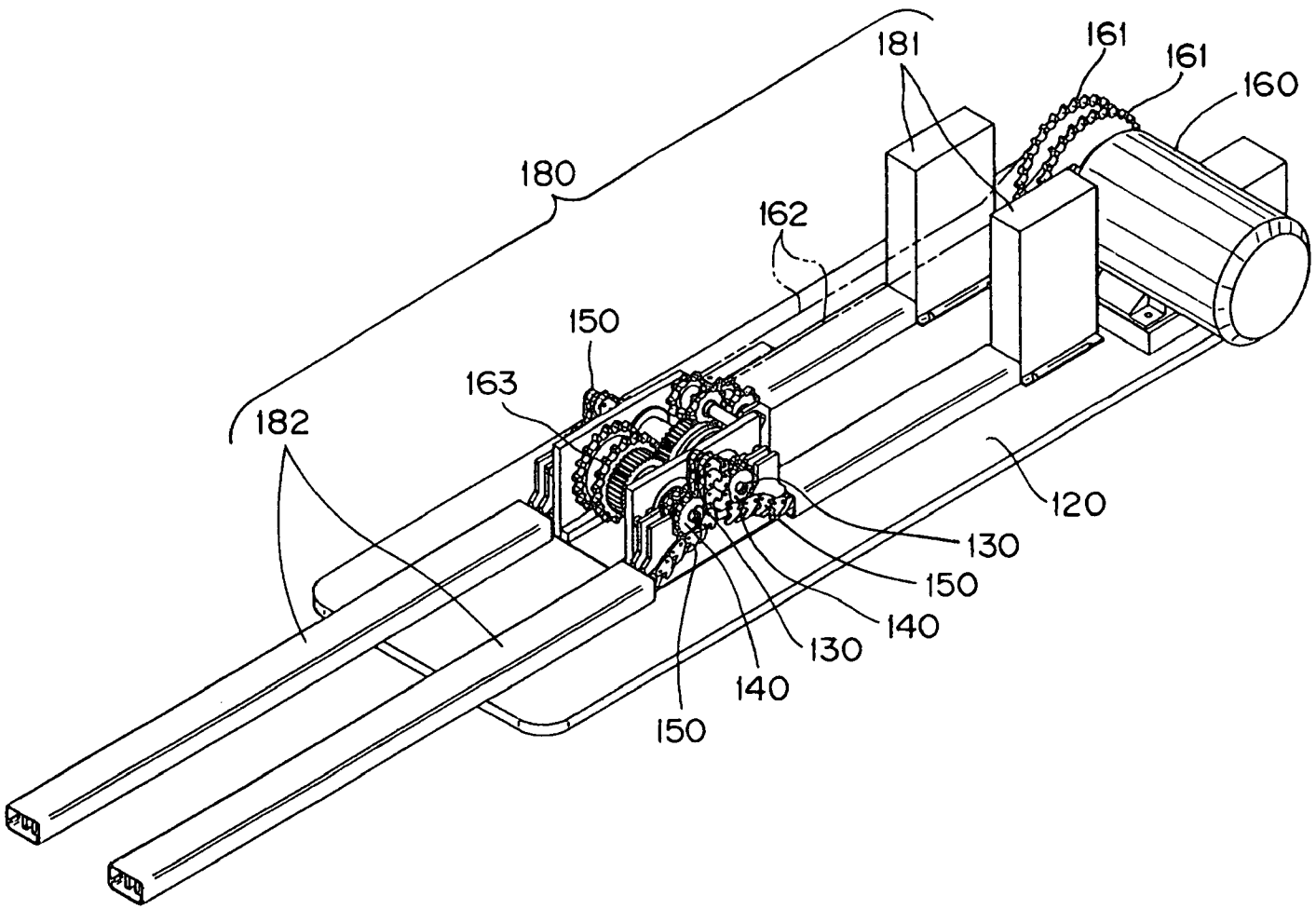
FIG. 2 is a perspective view of a state where a hoisting and lowering table and a pantograph arm are removed from the embodiment shown in FIG. 1.
Figure 3:
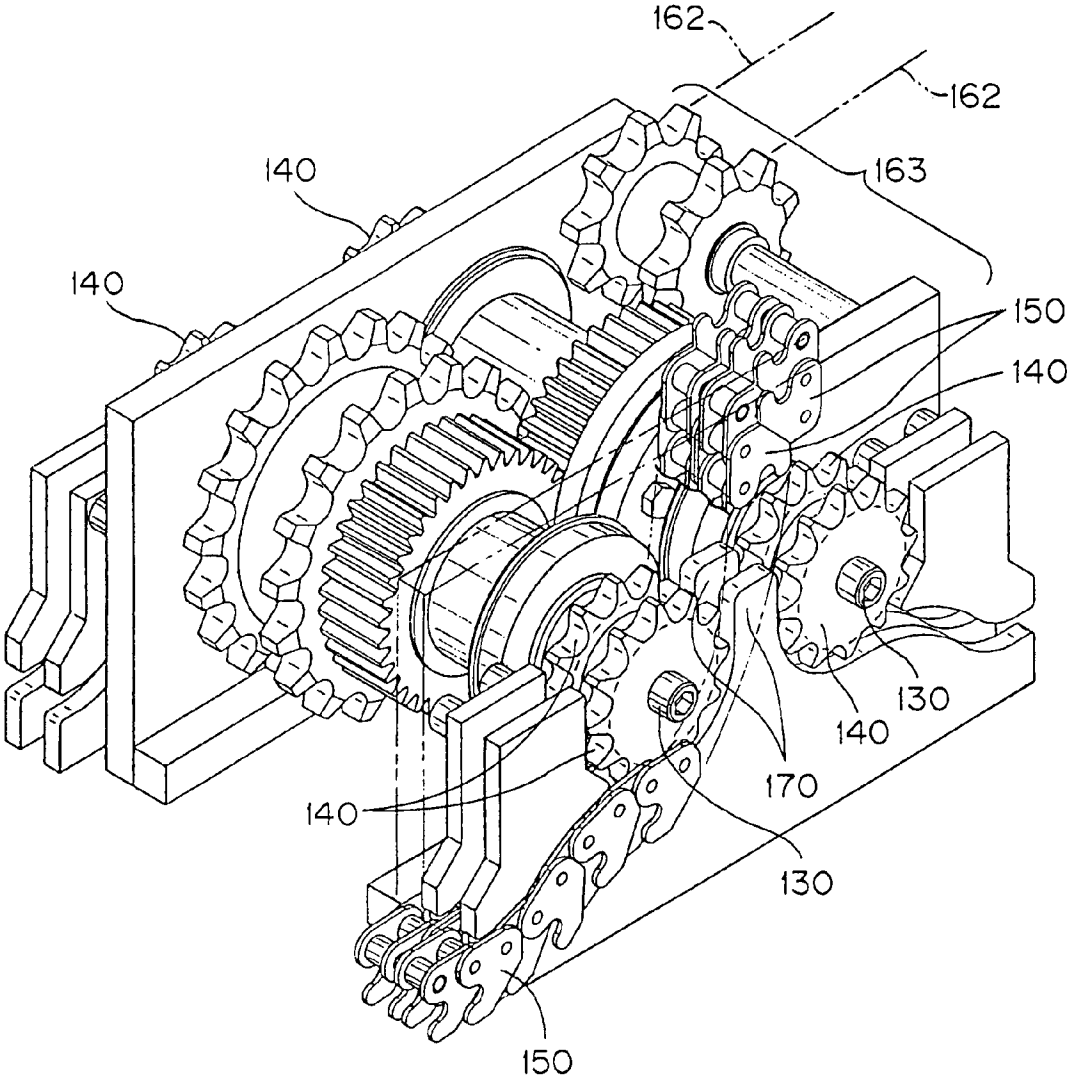
FIG. 3 is a partially enlarged view of a portion of the invention in the vicinity of a hoisting and lowering driving sprocket shown in FIG. 2.

It is noted that the reference numerals 161, 161 shown in FIGS. 1 and 2, denote a pair of driving sprockets coaxially arranged on an output shaft side of the driving motor 160, the reference numerals 162, 162 denote a pair of power transmission chains composed of roller chains for transmitting power from the driving sprockets 161, 161 to a side of a pair of hoisting and lowering sprockets 140, 140, and the reference numerals 163, 163 shown in FIG. 3 denote a speed change gear group, which transmits power from the pair of power transmission chains 162, 162 to the pair of hoisting and lowering sprockets 140, 140 so that directional rotation is changed and positive and reverse rotations are performed in opposite directions to each other.

In the engagement chain type hoisting and lowering device 100, which is the first embodiment of the present invention, a chain guide plate 170, which guides a pair of hoisting and lowering driving engagement chains 150, 150, which are disengaged from the pair of hoisting and lowering sprockets 140, 140, is provided in a region between the facing pair of hoisting and lowering sprockets 140, 140, as shown in FIG. 3 so that a pair of hoisting and lowering driving engagement chains 150, 150 are engaged with each other just after the deflection driving from a horizontal direction to a vertical direction to be integrally hoisted in an engaged state.

Further, the above-described driving motor 160 is disposed in a peripheral area spaced apart from the lowest lowered position of the hoisting and lowering table 110, that is, in a portion other than a region under the projection of the hoisting and lowering table 110 as shown in FIG. 1 and the like.

Further, the above-described chain accommodating means 180 is also disposed in a peripheral area spaced apart from the lowest lowered position of the hoisting and lowering table 110, that is, in a portion other than a region under the projection of the hoisting and lowering table 110 as well as the driving motor 160 as shown in FIG. 1. That is, one of a pair of hoisting and lowering driving engagement chains 150, 150 disengaged from each other and branched is accommodated in a chain accommodating means 180 composed of a winding type accommodating box 181 disposed on a driving motor 160 side and the other of the pair of hoisting and lowering driving engagement chains 150, 150 is accommodated in a chain accommodating means 180 composed of a linear accommodating rail 182 disposed at the opposite side to the driving motor 160.

Therefore, in the engagement chain type hoisting and lowering device 100, the lowest lowered position of the hoisting and lowering table 110 can be lowered irrespective of sizes or heights of this driving motor 160 and the engagement chain accommodating means 180. That is, since the floor of the hoisting and lowering table 110 can be lowered, an operational burden of loading and unloading of articles to be hoisted onto and lowered from the hoisting and lowering table 110 can be significantly reduced and at the same time the driving motor 160 and the engagement chain accommodating means 180 do not become obstructions during maintenance of a hoisting and lowering mechanism so that a safe and simple maintenance operation can be attained.

Further, as shown in FIG. 1, the engagement chain type hoisting and lowering device 100 is formed so that stable hoisting and lowering operations of the hoisting and lowering table 110 are guided by intervening upper and lower two steps connected hoisting and lowering auxiliary guide means 190 composed of an inner arm 191 and an outer arm 192, a so-called X-shaped pantograph arm between the hoisting and lowering table 110 and a set surface side base plate 120. It is noted that the reference numeral 193 shown in FIG. 1 and the like denotes slide rails for sliding lower ends of the inner arms 191 in accordance with hoisting and lowering operations.

Figure 4:
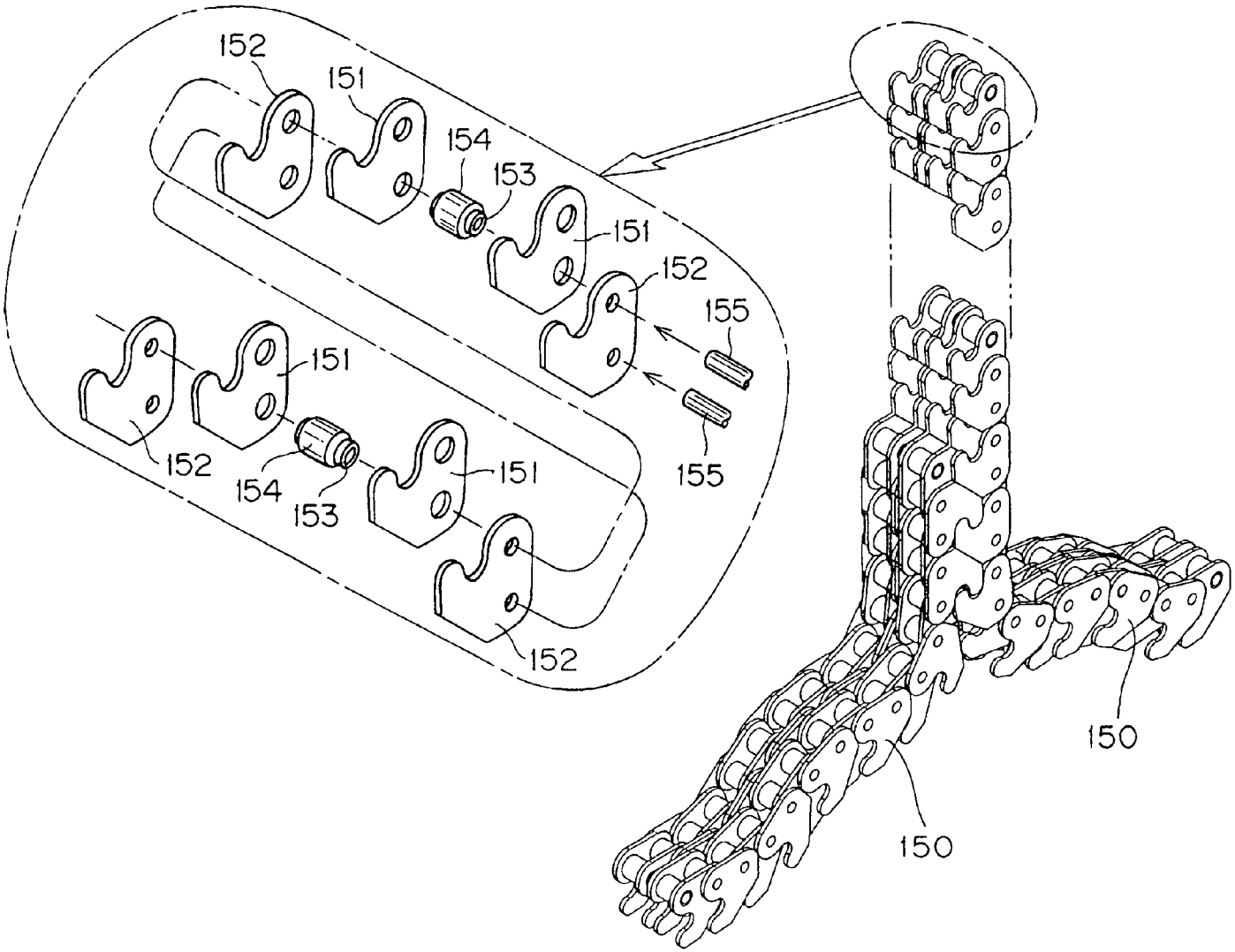
FIG. 4 is a partially disassembled view showing a hoisting and lowering driving engagement chain used in FIG. 1.

Then, a pair of hoisting and lowering driving engagement chains 150, 150, which are the most characteristic portions of the engagement chain type hoisting and lowering device 100, which is the first embodiment of the present invention, so-called chuck chains, are respectively composed, as shown in FIG. 4, in two rows of chain links in a chain width direction by use of a hook-shaped inner tooth plate 151, a hook-shaped outer tooth plate 152, which overlaps the inner tooth plate while shifted by a half pitch with respect to the inner tooth plate 151 in a longitudinal direction of the chain, a bush 153, which connects and fixes the inner tooth plates 151 in the chain width direction, a roller 154 fitted onto the bush and connecting pins, which connect and fix the outer tooth plates 152 in the chain width direction. Further, the pair of hoisting and lowering driving engagement chains 150, 150 are arranged so that they are engaged with each other just after deflection driving from the horizontal direction to the vertical direction along the above-described chain guide plates 170 to be integrally hoisted in an engaged state and also they are disengaged from each other during deflection driving by a pair of hoisting and lowering sprockets 140, 140 from the vertical direction to the horizontal direction to be branched.

And an inner tooth plate 151 and an outer tooth plate 152 forming one of the pair of hoisting and lowering driving engagement chains 150, 150 multiply and strongly engage with an inner tooth plate 151 and an outer tooth plate 152 forming the other opposite hoisting and lowering driving engagement chain 150 so as to be a hook shape, also called a chuck shape, over a plurality of rows of chain links in a chain width direction. Thus, even if a biased load is loaded on one side of the hoisting and lowering driving engagement chains 150, 150, which hoist and lower in an engaged state while supporting the entire load containing loaded articles to be hoisted and lowered over a plurality of rows of chain links in the chain width direction, buckling of the hoisting and lowering driving engagement chain 150, liable to occur in the chain width direction, is reliably suppressed.

Further, in the engagement chain type hoisting and lowering device 100, which is the first embodiment of the present invention, since the above-described pair of hoisting and lowering driving engagement chains 150, 150 are respectively arranged on both right and left sides of the hoisting and lowering table 110, the hoisting and lowering driving engagement chains 150, 150 are arranged in two sets. Even if articles to be hoisted and lowered are loaded on the hoisting and lowering table 110 in a biased state and, even if there is a fear of rolling of the chain, liable to occur in a width direction of the hoisting and lowering table 110 near the most upper hoisted position of the hoisting and lowering table 110, a pair of hoisting and lowering driving engagement chains 150, 150 respectively arranged on both right and left sides of the hoisting and lowering table 110 are hoisted and lowered in an engaged state where the entire load containing loaded articles to be hoisted and lowered loaded is shared into two parts and thereby reduced.

Figure 5:
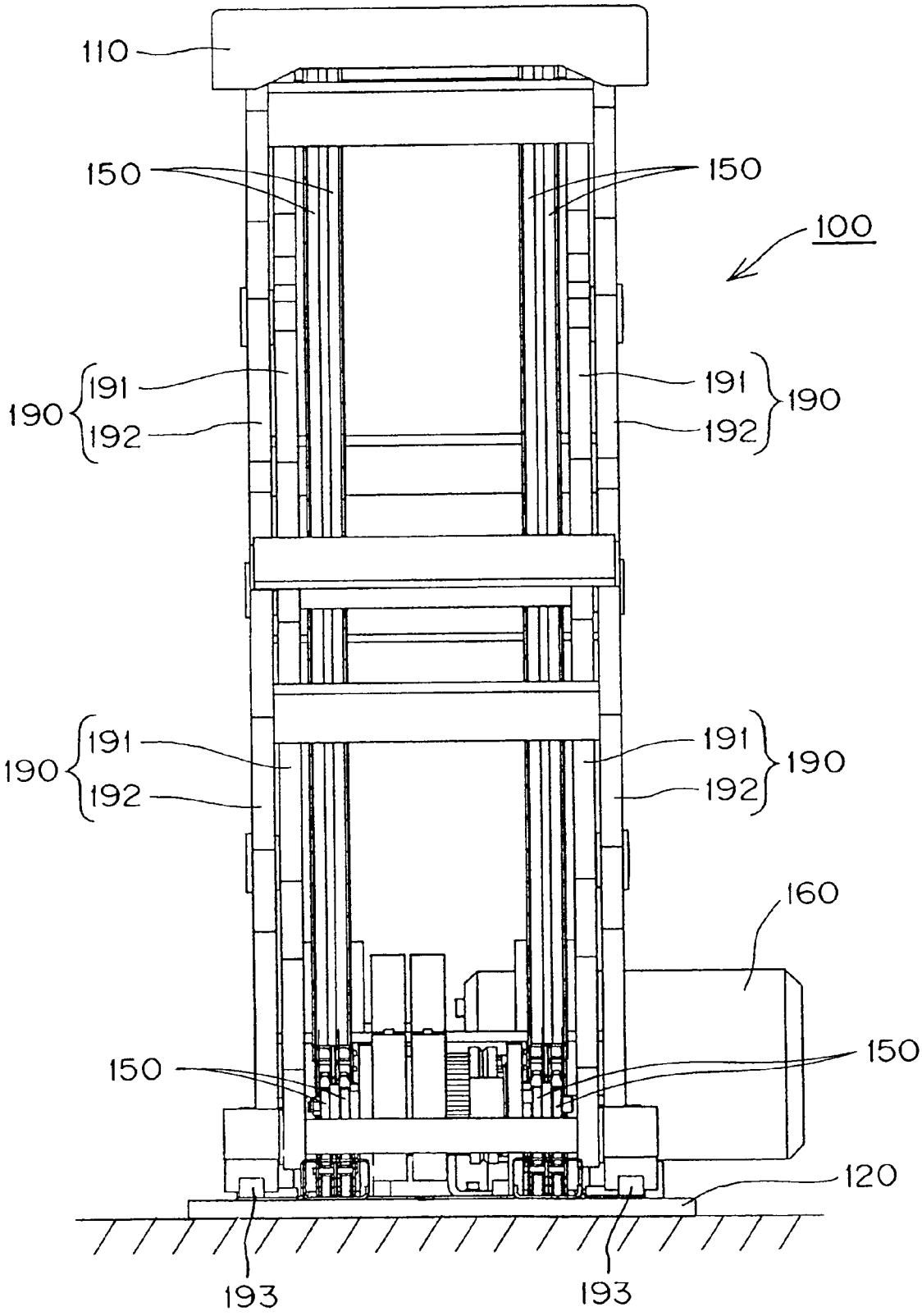
FIG. 5 is a front view showing the most upper hoisted position of the engagement chain type hoisting and lowering device of the embodiment of the invention shown in FIG. 1.
Figure 6:
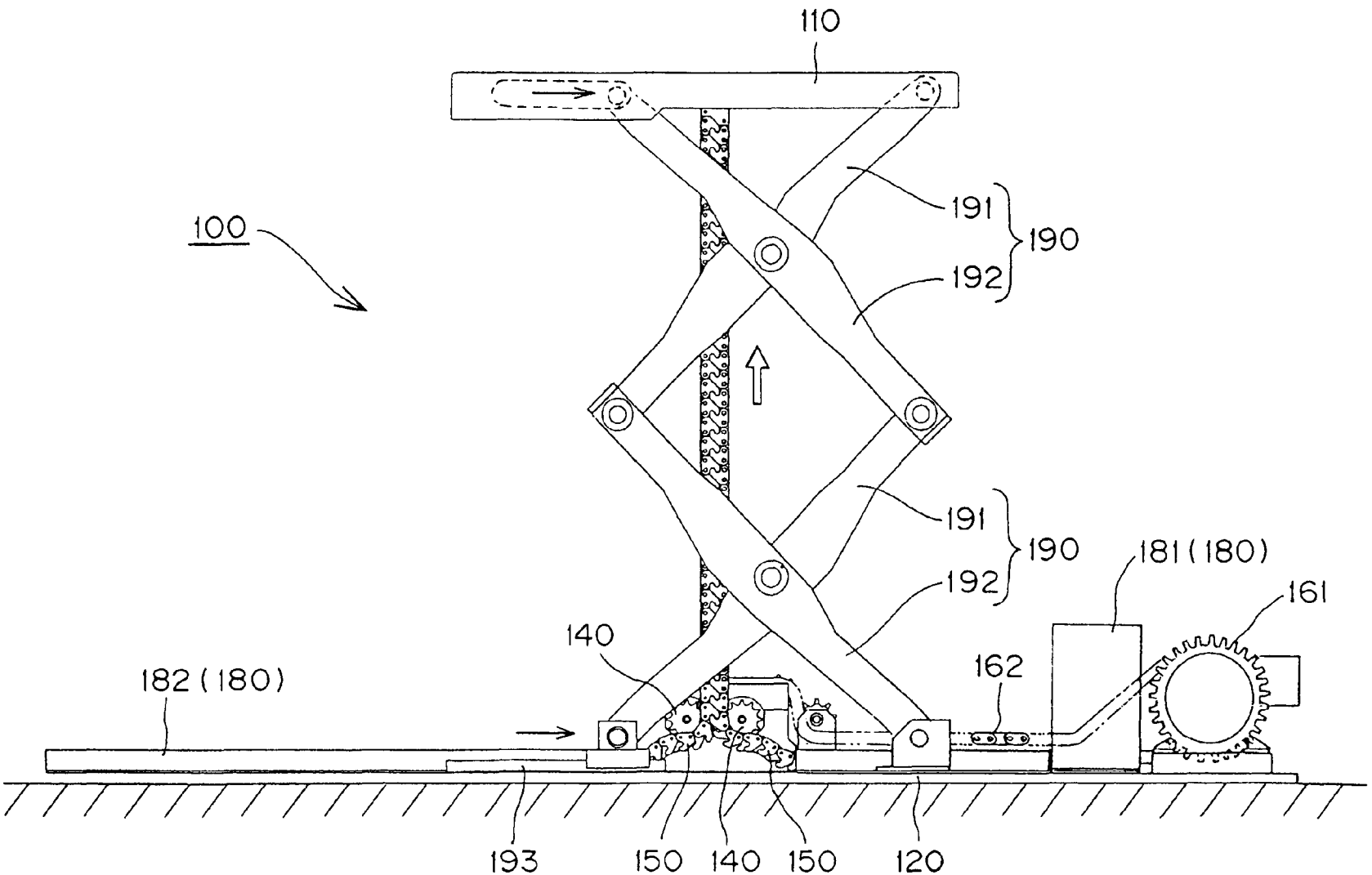
FIG. 6 is a side view showing the most upper hoisted position of the engagement chain type hoisting and lowering device of the embodiment of the invention shown in FIG. 1.

Next, hoisting and lowering operations of the engagement chain type hoisting and lowering device 100, which is the first embodiment of the present invention, will be explained based on FIG. 1 and FIGS. 5 to 9. First, as shown in FIG. 1 and FIGS. 5 to 6, in a case where a hoisting and lowering table 110 reaches the most upper hoisted position, a pair of hoisting and lowering driving engagement chains 150, 150 are respectively sent out from a chain accommodating means 180 composed of a chain accommodating box 181 and a linear accommodating rail 182 by a pair of hoisting and lowering sprockets 140, 140, and the pair of hoisting and lowering driving engagement chains 150, 150 are rapidly hoisted at the same speed in accordance with an output of a driving motor 160 while supporting the entire weight of the hoisting and lowering table 110 loading articles to be hoisted and lowered (not shown) composed of heavy articles. It is noted at this time that upper and lower two step connected form hoisting and lowering auxiliary guide means 190 composed of an inner arm 191 and an outer arm 192, the above-described X-shaped pantograph arm, guides a stable hoisting operation of the hoisting and lowering table 110.

Figure 7:
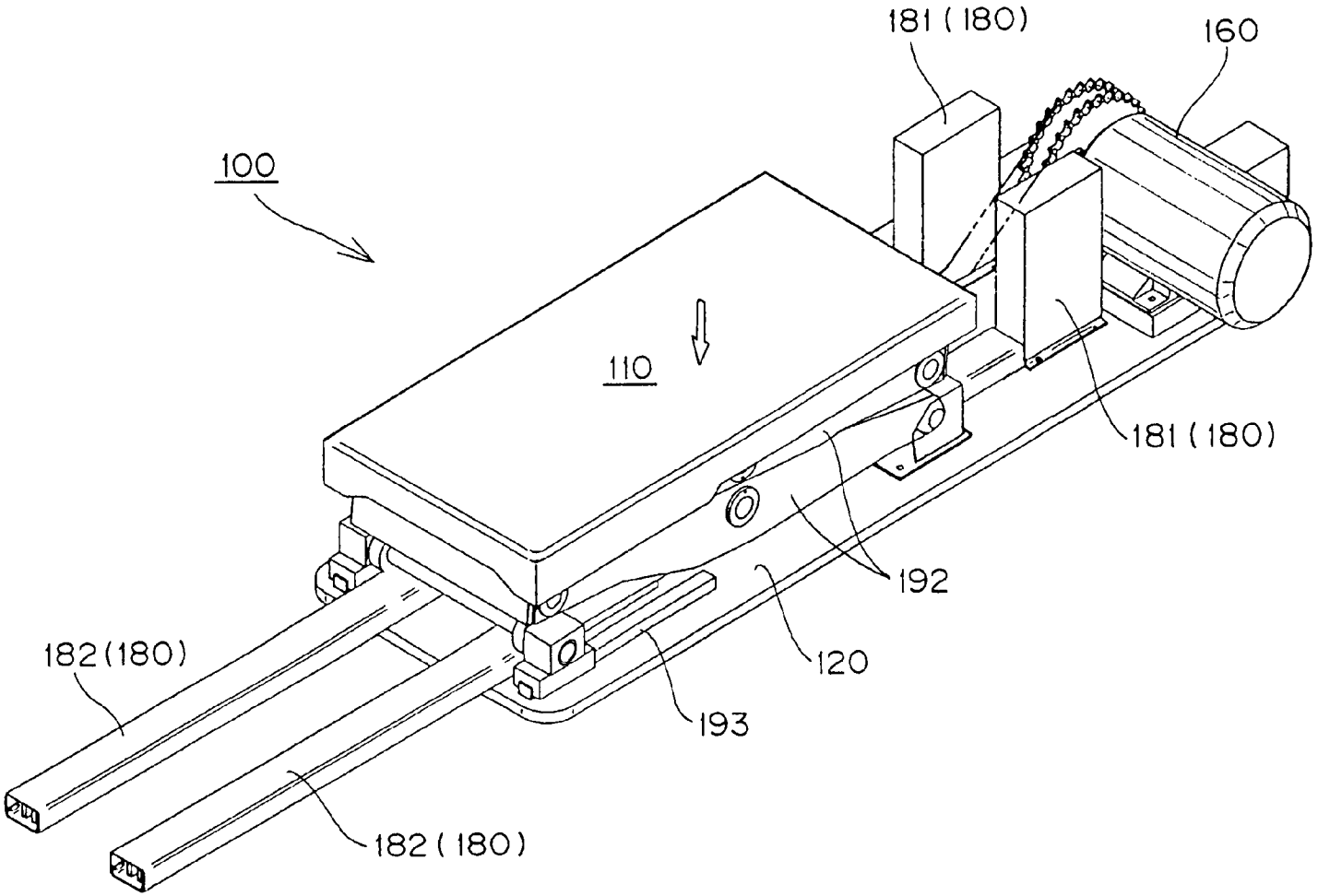
FIG. 7 is a perspective view of the embodiment of the invention shown in FIG. 1 showing the lowest lowered position of the engagement chain type hoisting and lowering device.
Figure 8:
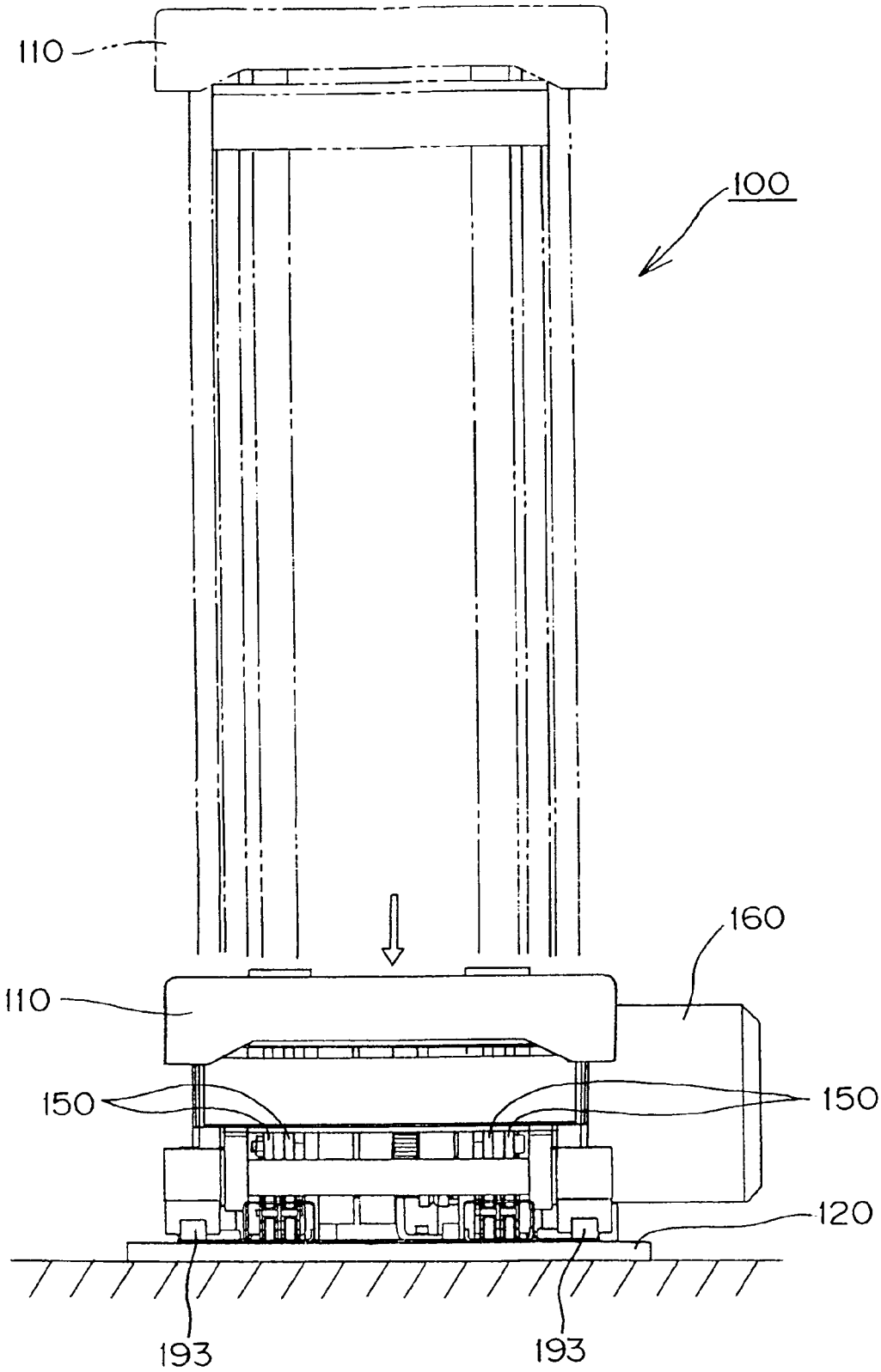
FIG. 8 is a front view of the embodiment of the invention shown in FIG. 1, showing the lowest lowered position of the engagement chain type hoisting and lowering device.
Figure 9:
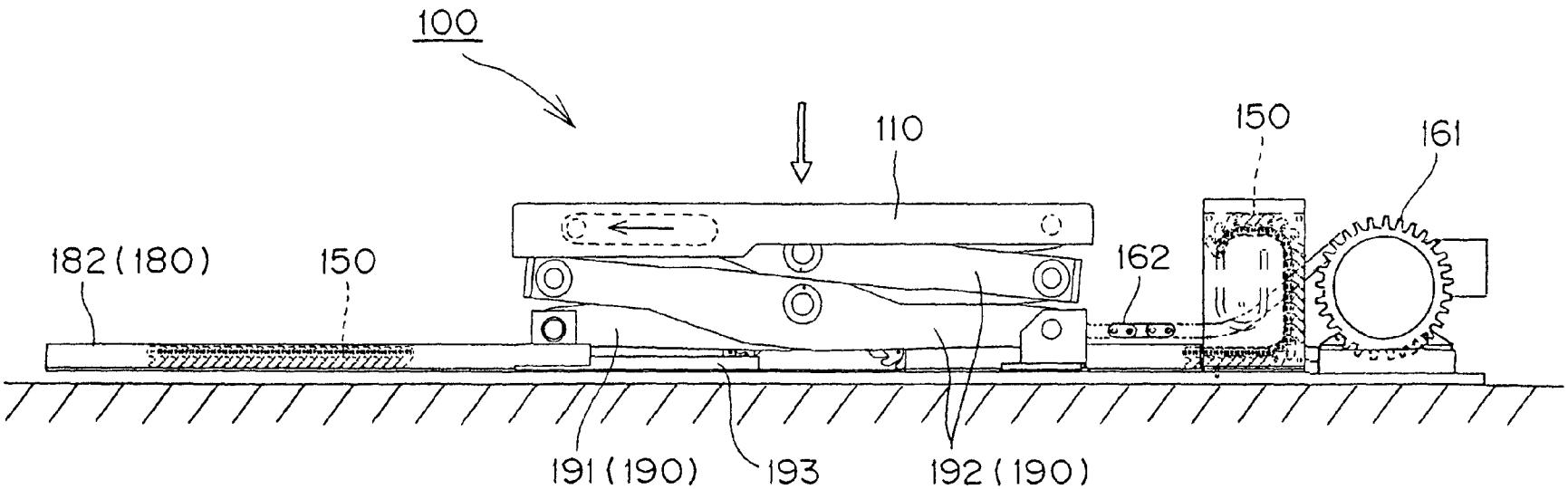
FIG. 9 is a side view of the embodiment of the invention shown in FIG. 1, showing the lowest lowered position of the engagement chain type hoisting and lowering device.
Figure 10:
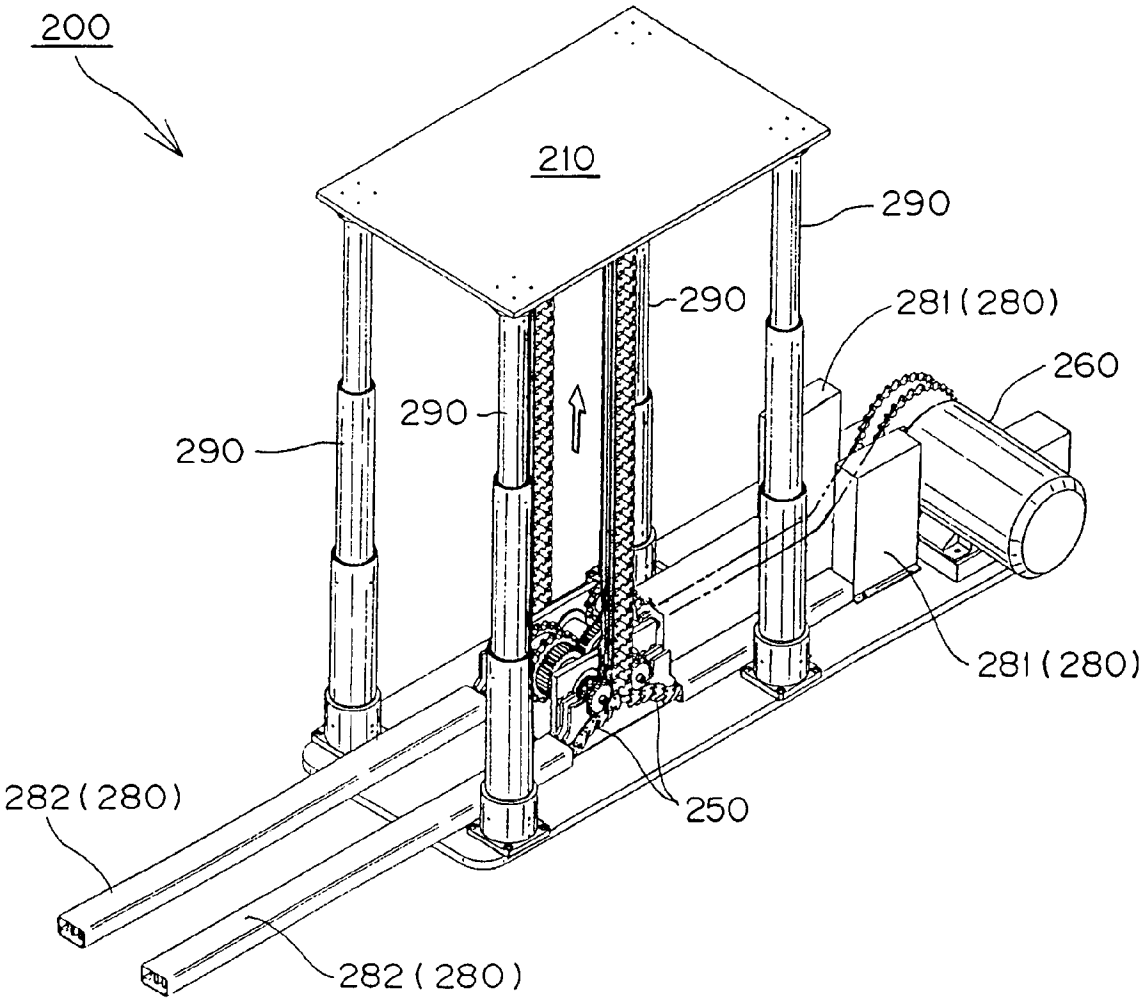
FIG. 10 is a perspective view of a second embodiment of the invention, showing the lowest lowered position of an engagement chain type hoisting and lowering device.

On the other hand, as shown in FIGS. 7 to 9, in a case where the hoisting and lowering table 110 reaches the lowest lowered position, a pair of hoisting and lowering driving engagement chains 150, 150 are respectively drawn into the chain accommodating means 180 composed of a chain accommodating box 181 and a linear accommodating rail 182 by a pair of hoisting and lowering sprockets 140, 140, while being branched, and the pair of hoisting and lowering driving engagement chains 150, 150 are rapidly lowered at the same speed in accordance with an output of a driving motor 160 while supporting the entire weight of the hoisting and lowering table 110 loading articles to be hoisted and lowered (not shown) composed of heavy articles. It is noted at this time that upper and lower two step connected form hoisting and lowering auxiliary guide means 190, composed of the above-described X-shaped inner arm 191 and an outer arm 192, guides a stable lowering operation of the hoisting and lowering table 110 while being folded.

As described above, in the engagement chain type hoisting and lowering device 100, which is the first embodiment of the present invention, since the pair of hoisting and lowering driving engagement chains 150, 150, respectively arranged on both right and left sides of the hoisting and lowering table 110 are hoisted in an engaged state where the entire weight containing loaded articles to be hoisted and lowered is divided or shared into two parts, articles to be hoisted and lowered can be stably hoisted and lowered on a horizontal loading surface. And an inner tooth plate 151 and an outer tooth plate 152 forming one of the pair of hoisting and lowering driving engagement chains 150, 150, multiply and strongly engage with an inner tooth plate 151 and an outer tooth plate 152 forming the other opposite hoisting and lowering driving engagement chain 150 so as to be a hook shape, also called a chuck shape, over a plurality of rows of chain links in a chain width direction. Thus, even if a biased load is loaded on one side of the hoisting and lowering table 110, buckling of the hoisting and lowering driving engagement chain 150, liable to occur in the chain width direction, is reliably suppressed so that excellent endurance of the chain can realized. Additionally, since a biased load is not acted on, an upper and lower two steps connected form hoisting and lowing auxiliary guide means 190 composed of X-shaped inner arm 191 and outer arm 192, a smooth extendable guide function of the hoisting and lowering auxiliary guide means 190 in accordance with the hoisting and lowering driving of the pair of hoisting and lowering driving engagement chains 150, 150, can be attained.

Additionally, the engagement chain type hoisting and lowering device 100, which is the first embodiment of the present invention, can realize high design flexibility of driving parts containing the chain accommodating means 180 and the driving motor 160, and the lowest lowered position of the hoisting and lowering table 110 can be lowered irrespective of sizes or heights of the driving motor 160 and the chain accommodating means 180. That is, since the floor of the hoisting and lowering table 110 can be lowered, an operational burden of loading and unloading of articles to be hoisted onto and lowered from the hoisting and lowering table 110 can be significantly reduced and at the same time the driving motor 160 and the chain accommodating means 180 do not become obstructions during maintenance of a hoisting and lowering mechanism so that a safe and simple maintenance operation can be attained. Thus, the benefits of the first embodiment of the present invention are very large.

Next, FIG. 8 shows an engagement chain type hoisting and lowering device 200, which is a second embodiment of the present invention. Since the engagement chain type hoisting and lowering device 200, which is the second embodiment of the present invention has just the same basic device configurations as those of the engagement chain type hoisting and lowering device 100, which is the above-described first embodiment, its explanation is omitted by changing the reference numerals of the 100s denoted to the same members to the 200s. Therefore, since in the engagement chain type hoisting and lowering device 200, which is the second embodiment of the present invention, only a hoisting and lowering auxiliary means 290 is different from the above-described engagement chain type hoisting and lowering device 100, which is the first embodiment of the present invention, only this hoisting and lowering auxiliary means 290 will be described below.

That is, according the engagement chain type hoisting and lowering device 200, which is the second embodiment of the present invention, a hoisting and lowering guide means 290 composed of telescopic pipes each diameter-reduced upward are intervened at four positions between a hoisting and lowering table 210 and a set surface side base plate 220 so that stable hoisting and lowering operations of the hoisting and lowering table 210 are guided.

In the thus obtained engagement chain type hoisting and lowering device 200, which is the second embodiment of the present invention, since a pair of hoisting and lowering driving engagement chains 250, 250, respectively arranged on both right and left sides of the hoisting and lowering table 210, are hoisted in an engaged state where the entire weight containing loaded articles to be hoisted and lowered is divided or shared into two parts like the engagement chain type hoisting and lowering device 100, which is the first embodiment of the present invention, articles to be hoisted and lowered can be stably hoisted and lowered on a horizontal loading surface. An inner tooth plate 251 and an outer tooth plate 252 forming one of the pair of hoisting and lowering driving engagement chains 250, 250, multiply and strongly engage with an inner tooth plate 251 and an outer tooth plate 252 forming the other opposite hoisting and lowering driving engagement chain 250 so as to be a hook shape, also called a chuck shape, over a plurality of rows of chain links in a chain width direction. Thus, even if a biased load is loaded on one side of the hoisting and lowering table 210, buckling of the hoisting and lowering driving engagement chain 250, liable to occur in the chain width direction, is reliably suppressed so that excellent endurance of the chain can be realized.

Additionally, since in the engagement chain type hoisting and lowering device 200, which is the second embodiment of the present invention, a driving motor 260 and an engagement chain accommodating means 280 are disposed in a peripheral area spaced apart from the lowest lowered position of the hoisting and lowering table 210 like the above-described engagement chain type hoisting and lowering device 100, which is the first embodiment of the present invention, the floor of the hoisting and lowering table 210 can be lowered irrespective of sizes or heights of the driving motor 260 and the engagement chain accommodating means 280. Therefore, an operational burden of loading and unloading of articles to be hoisted onto and lowered from the hoisting and lowering table 210 can be significantly reduced, and at the same time the driving motor 260 and the engagement chain accommodating means 280 do not become an obstruction during maintenance of a hoisting and lowering mechanism so that a safe and simple maintenance operation can be attained. Thus, the benefits of the second embodiment of the present invention are very large.

We claim:

1. A hoisting and lowering device having engagement chains, comprising:

a base plate;

a first pair of hoisting and lowering sprockets, wherein each of said hoisting and lowering sprockets in said first pair of hoisting and lowering sprockets rotate positively and reversely in opposite directions while facing each other in the same plane about a pair of rotation shafts arranged in parallel with a the base plate;

a second pair of hoisting and lowering sprockets, wherein each of said hoisting and lowering sprockets in said second set of hoisting and lowering sprockets rotate positively and reversely in opposite directions while facing each other in the same plane about a pair of rotation shafts arranged in parallel with the base plate;

a first pair of hoisting and lowering driving engagement chains, including a first hoisting and lowering driving engagement chain and a second hoisting and lowering driving engagement chain, wherein the first hoisting and lowering driving engagement chain of the first pair of hoisting and lowering driving engagement chains engages with the second hoisting and lowering driving engagement chain of the first pair of hoisting and lowering driving engagement chains just after deflection driving of said first and second hoisting and lowering driving engagement chains from a horizontal direction to a vertical direction by said first pair of hoisting and lowering sprockets rotating in a first direction causing said first pair of hoisting and lowering driving engagement chains to rise integrally in an engaged state, and also the first hoisting and lowering driving engagement chain of the first pair of hoisting and lowering driving engagement chains disengages from the second hoisting and lowering driving engagement chain of the first pair of hoisting and lowering driving engagement chains to be branched from the vertical direction to the horizontal direction by the first pair of hoisting and lowering sprockets rotating in a second direction opposite from the first direction during deflection driving;

a second pair of hoisting and lowering driving engagement chains, including a third hoisting and lowering driving engagement chain and a fourth hoisting and lowering driving engagement chain, wherein the third hoisting and lowering driving engagement chain of the second pair of hoisting and lowering driving engagement chains engages with the fourth hoisting and lowering driving engagement chain of the second pair of hoisting and lowering driving engagement chains just after deflection driving of said third and fourth hoisting and lowering driving engagement chains from the horizontal direction to the vertical direction by said second pair of hoisting and lowering sprockets rotating in a first direction causing said second pair of hoisting and lowering driving engagement chains to rise integrally in an engaged state, and also the third hoisting and lowering driving engagement chain of the second pair of hoisting and lowering driving engagement chains disengages from the fourth hoisting and lowering driving engagement chain of the second pair of hoisting and lowering driving engagement chains to be branched from the vertical direction to the horizontal direction by the second pair of sprockets rotating in a second direction opposite from the first direction during deflection driving;

a hoisting and lowering table having a first side, a second side opposite said first side, and two ends, wherein said hoisting and lowering table is securely attached to an upper end of said first pair of hoisting and lowering driving engagement chains, and wherein said hoisting and lowering table is securely attached to an upper end of said second pair of hoisting and lowering driving engagement chains;

wherein said first pair of hoisting and lowering driving engagement chains is arranged on said first side of said hoisting and lowering table, and said second pair of hoisting and lowering driving engagement chains is arranged on said second side of said hoisting and lowering table;

a driving motor, which drives one or more driving sprockets, which in turn drive one or more power transmission chains, which in turn drive said first pair of hoisting and lowering sprockets causing said first pair of hoisting and lowering sprockets to rotate positively and reversely in opposite directions, and which drive said second pair of hoisting and lowering sprockets causing said second pair of hoisting and lowering sprockets to rotate positively and reversely in opposite directions;

wherein said one or more power transmission chains are configured to travel proximate to and substantially parallel to the base plate;

wherein said one or more power transmission chains are disposed below the hoisting and lowering table at the lowest lowered position of said hoisting and lowering table;

wherein, when viewed from above, said driving motor is disposed outside of the area occupied by the hoisting and lowering table at the lowest lowered position of said hoisting and lowering table;

chain accommodating means for said first pair of hoisting and lowering driving engagement chains while being branched in the horizontal direction when said first hoisting and lowering driving engagement chain and said second hoisting and lowering driving engagement chain are in the disengaged condition;

chain accommodating means for said second pair of hoisting and lowering driving engagement chains while being branched in the horizontal direction when said third hoisting and lowering driving engagement chain and said fourth hoisting and lowering driving engagement chain are in the disengaged condition; and, wherein, when viewed from above, the chain accommodating means for said first pair of hoisting and lowering driving engagement chains and the chain accommodating means for said second pair of hoisting and lowering driving engagement chains are disposed outside of the area occupied by the hoisting and lowering table at the lowest lowered position of said hoisting and lowering table.

2. The hoisting and lowering device having engagement chains according to claim 1 further comprising:

said first, second, third, and fourth hoisting and lowering driving engagement chains each include: (1) a plurality of rows of chain links in a chain width direction having hook-shaped inner tooth plates, and hook-shaped outer tooth plates which overlap said hook-shaped inner tooth plates while being shifted by a half pitch with respect to said inner tooth plates in a longitudinal direction of the chain, (2) a bush, which connects and fixes said inner plates in the chain width direction, and (3) a roller fitted onto said bush and a connecting pin connected to be fixed to said outer tooth plates in the chain width direction.

* * * * *